US006347859B1

(12) United States Patent
Kawakami et al.

(10) Patent No.: US 6,347,859 B1
(45) Date of Patent: Feb. 19, 2002

(54) INJET PRINT HEAD AND INJET RECORDER

(75) Inventors: Hiroshi Kawakami; Yo Saito; Kazuhiro Shimada; Takeshi Tomizawa, all of Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/606,447

(22) Filed: Jun. 29, 2000

(30) Foreign Application Priority Data

Jul. 2, 1999 (JP) ..... 11-224375

(51) Int. Cl.[7] ..... B41J 2/15; B41J 2/145; B41J 2/135

(52) U.S. Cl. ..... 347/40; 347/20; 347/44; 347/45

(58) Field of Search ..... 347/22, 29, 40, 347/44, 45, 46, 47, 20

(56) References Cited

U.S. PATENT DOCUMENTS 5,815,177 A * 9/1998 Sasaki ..... 347/44

FOREIGN PATENT DOCUMENTS

| | | |
|---|---|---|
| JP | 60-192673 | 10/1985 |
| JP | 62-1833 | 1/1987 |
| JP | 63-4956 | 1/1988 |
| JP | 1-275047 | 11/1989 |
| JP | 4-169238 | 6/1992 |
| JP | 5-201000 | 8/1993 |
| JP | 5-330041 | 12/1993 |
| JP | 10-305583 | 11/1998 |

* cited by examiner

*Primary Examiner*—Huan Tran
(74) *Attorney, Agent, or Firm*—Flynn, Thiel, Boutell & Tanis, P.C.

(57) ABSTRACT

An inkjet print head of an inkjet recorder is provided with a masking plate (or nozzle protecting plate), which is of such configuration as to securely protect the nozzle face against contact and collision with a recording medium and adherence of foreign matter on the recording medium, and to prevent undesired ink droplets from collecting on the masking plate (or nozzle protecting plate) or the nozzle face. The inkjet print head with an assembly of more than one nozzle is designed to be scanned over a cloth while injecting inks from said nozzles onto the cloth to form image patterns on it, and is made up of a nozzle protecting plate mounted on the print head at a given distance from the nozzle face, the nozzle protecting plate having an opening or openings formed as a path or paths for discharge of the inks. The inkjet print head of the present invention can securely protect the nozzle face against contact and collision with a recording medium and adherence of foreign matter on the recording medium to it, irrespective of the arrangement of the nozzles and the type of the recording medium used.

7 Claims, 8 Drawing Sheets

INJET PRINT HEAD AND INJET RECORDER

BACKGROUND OF THE INVENTION

1. Field of the Invention

This invention relates to an inkjet recorder and more particularly to an inkjet print head designed to inject ink droplets onto a recording medium such as a cloth to form image patterns on the cloth.

2. Prior Art

Conventional recording means using ink include an inkjet recording system.

Due to its light weight, possible miniaturization and low noise level, this recording system has enjoyed wide application in the printing/recording field, allowing use of a wide range of recording mediums.

Especially when this recording system is used as an inkjet printer for printing on a cloth, it is very advantageous in that it can represent fine and multicolor patterns on the cloth with clear boundaries of the patterns in a way not obtainable with any other conventional textile printing technique, as well as that it can achieve great cuts in process loads such as engraving involved in a conventional textile printing process.

Therefore, inkjet printing has now attracted attention from the textile industry as a technology to provide for high-quality textile printing on a multi-variety small-lot production basis.

Inkjet recording systems commonly adopted for such textile printing on a commercial basis is of a type wherein an inkjet print head with nozzles is scanned over a cloth in the direction perpendicular to that in which the cloth is fed, while injecting inks from the nozzles to form image patterns on it.

The important problem with the inkjet print head that must be addressed at the present time, when there has been a demand for high productivity and high quality, is how to allow the ink from the inkjet print head to reach the surface of the cloth with accuracy and improve the quality of the image patterns thus printed on it.

To solve this problem, it is very important to improve the ink discharge stability of the inkjet print head, allowing it to discharge ink droplets continuously in a stable state at all times.

However, a conventional inkjet print head of the prior art presents problems with its ink discharge stability such as ink trajectory inaccuracy and ink discharge failure, resulting in improper printing on a recording medium and marked deterioration in the quality of the image patterns formed on the medium.

One of the factors causing these problems is that the recording medium is contaminated with dust, dirt and other foreign matter, which adheres to the nozzles of the inkjet print head and/or their peripheral areas.

Another factor considered as a cause of the problems is that the recording medium is creased or floats, coming into contact or collision with the nozzles of the inkjet print head with resultant damage to them and/or their peripheral areas.

As a countermeasure against such problems, JP-A-5-330041 disclosed the invention of an inkjet print head covered with a masking plate, wherein its ink discharge outlet ports forming a nozzle face is positioned 5 $\mu$m to 500 $\mu$m inside from the surface of the masking plate.

This prior art has allowed the inkjet print head's nozzles and their peripheral areas to be protected against contact with the recording medium and adherence of dust, dirt and other foreign matter present on it.

However, the aforementioned prior art inkjet print head with such a masking plate is disadvantageous in that the ink mist generated from the ink upon its discharge from the nozzles and the ink leaked from the nozzles are prone to collect on the nozzle face.

The above disadvantage of this prior art inkjet print head becomes larger as it is designed with the nozzle face positioned further inside from the masking plate surface to avoid the adherence of foreign matter on the recording medium to the nozzles.

In addition, this prior art inkjet print head has the disadvantage that the area formed between the nozzle face and the masking plate is prone to collect any undesired droplets from the cleaning solution used to clean the nozzle face to prevent the clogging of the nozzles after removal of dust and any other foreign matter from them.

The droplets thus collected in between the nozzle face and the masking plate causes problems such as blocking the trajectory of the ink and assembling into larger masses, which reach the surface of the recording medium, significantly deteriorating the quality of the image patterns formed on it.

The above means that this prior art inkjet print head has achieved success in protecting its nozzles by provision of such a masking plate as described above, but at the cost of deterioration in its printing performance.

To eliminate the above-described disadvantages, it is necessary to allow the ink inevitably adhering to the nozzle face and masking plate to detach smoothly from them before collecting on them to have adverse effects on its printing performance.

However, the prior art inkjet print head presented above, although proving its effectiveness in protecting its nozzles against adherence of foreign matter to them, cannot prevent adherence or collection of droplets onto the nozzle face and masking plate.

SUMMARY OF THE INVENTION

The invention disclosed herein was made against the background of the prior art involving the above-mentioned technical problems.

Accordingly, it is an object of the present invention to provide an inkjet recording system with an inkjet print head having a masking plate (nozzle protecting plate) of such configuration as to securely protect the nozzle face against contact and collision with a recording medium and adherence of foreign matter present on the medium to it and to prevent the masking plate and nozzle face from collecting droplets of the ink discharged from the print head.

The ultimate object of the present invention is to provide an inkjet print head with nozzles designed to assure smooth and stable discharge of ink from the nozzles onto a recording medium, thereby achieving improved quality of the image patterns formed on the recording medium.

Specifically, the present invention consists in (1) an inkjet print head with an assembly of more than one nozzle, designed to be scanned over a cloth while injecting inks from the nozzles onto the cloth to form image patterns on it, comprising a nozzle protecting plate mounted on the print head at a given distance from the nozzle face, said nozzle protecting plate having an opening or openings formed as a path or paths for discharge of the inks, (2) an inkjet print head with an assembly of more than one nozzle, designed to be scanned over a cloth while injecting inks from the nozzles onto the cloth to form image patterns on it, comprising a nozzle protecting plate mounted on the print head at a given distance from the nozzle face, said nozzle protecting plate having a slit or slits formed with its longer dimension parallel to the cloth feeding direction as a path or paths for discharge of the inks, (3) an inkjet print head as specified in (2) above, wherein two or more of said slits are provided in rows, (4) an inkjet print head as specified in (2), wherein said slit has an area extending downward from the nozzle area, (5) an inkjet print head as specified in (2), wherein the dimension of said slit perpendicular to the cloth feeding direction ranges from 0.4 mm to 1.5 mm, (6) an inkjet print head as specified in (1), wherein the distance between said nozzle protecting plate and nozzle face ranges from 0.4 mm to 2.5 mm, (7) an inkjet print head as specified in (1), wherein said nozzle protecting plate has its top and bottom (along the cloth feeding direction) inclined in one or more directions, (8) an inkjet print head as specified in (1), wherein said nozzle protecting plate has its surface treated to have a hydrophilic property, (9) an inkjet print head with an assembly of more than one nozzle, designed to be scanned over a cloth while injecting inks from the nozzles onto the cloth to form image patterns on it, comprising a nozzle protecting plate mounted on the print head at a distance of 0.4 to 2.5 mm from the nozzle face, said nozzle protecting plate having more than one slit formed in rows with its longer dimension parallel to the cloth feeding direction as paths for discharge of the inks, the dimension of said slit perpendicular to the cloth feeding direction ranging from 0.4 mm to 1.5 mm, said slit having an area extended downward from the nozzle area, and said nozzle protecting plate having its top and bottom (along the cloth feeding direction) inclined in one or two directions; and

(10) an inkjet recorder having such an inkjet print head as specified in (1).

The present invention naturally consists in combination of two or more selected from (3) to (8) mentioned above unless such combination departs from the spirit and object of the invention.

PREFERRED EMBODIMENT OF THE INVENTION

The inkjet recording system according to the present invention is of a type wherein an inkjet print head with nozzles is scanned over a cloth in the direction perpendicular to that in which the cloth is fed (as indicated by arrow X in FIG. 2) with simultaneous injection of ink from the nozzles, followed by the feed of the cloth with its subsequent scanning over the cloth in the direction perpendicular to the cloth feeding direction, which is thereafter repeated to record image patterns on the cloth.

This inkjet recording system is composed of such an inkjet print head as illustrated above, a drive unit to scan the inkjet print head (not shown) and a control unit to control the ink injecting nozzles (not shown).

The direction in which the cloth is fed will be hereinafter referred to as the "feeding direction" and the direction perpendicular to that in which the cloth is fed (or the direction in which the inkjet print head is scanned) as the "scanning direction".

Figure 1:
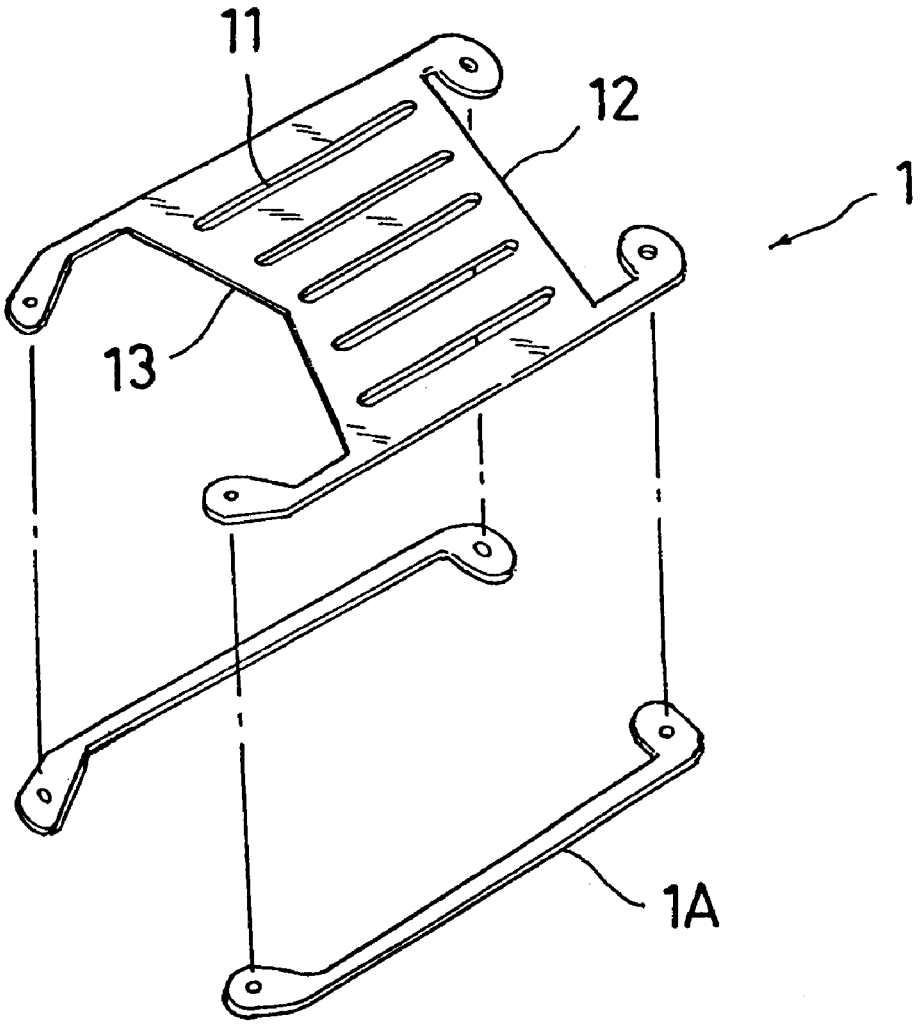
FIG. 1 is an outside view of a nozzle protecting plate embodying the present invention.
Figure 2:
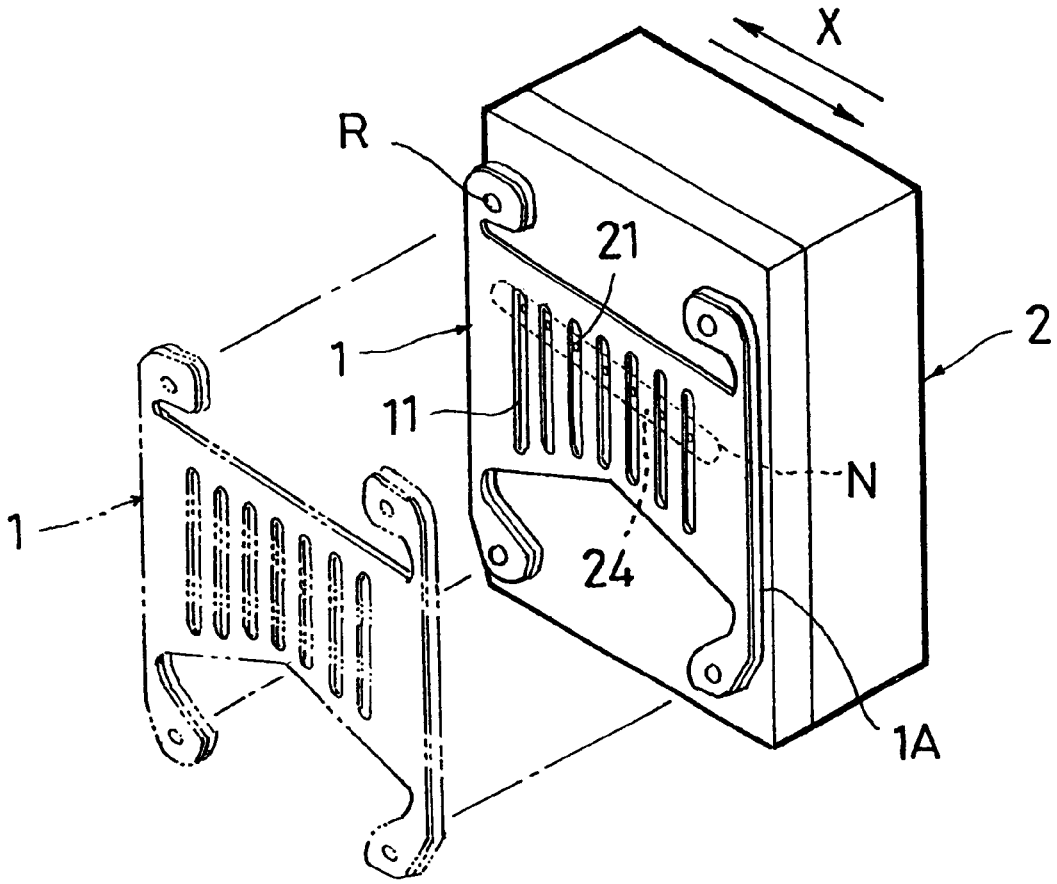
FIG. 2 shows an inkjet print head fitted with a nozzle protecting plate of the present invention.
Figure 3:
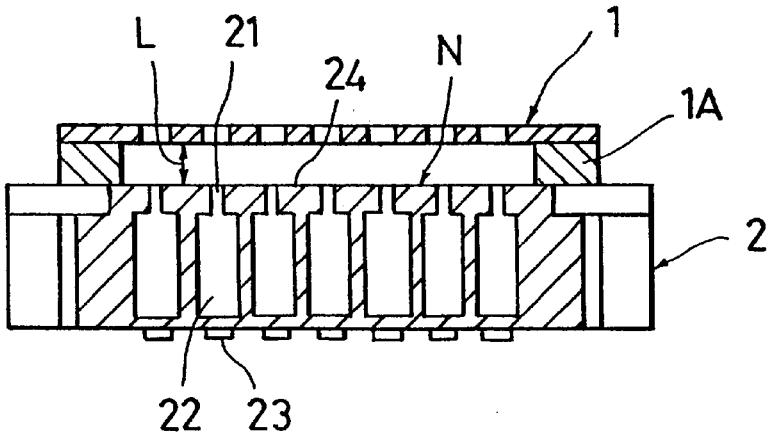
FIG. 3 is a sectional view of an inkjet print head fitted with a nozzle protecting plate of the present invention.

Referring to the attached drawings, a brief description of an inkjet print head 2 (as indicated in FIG. 2) is given in FIG. 3, which shows that said inkjet print head 2 consists of a pressure chamber 22 and an inkjet nozzle (also referred to as orifices) 21, and a piezoelectric element 23 placed in part of the bulkhead constituting said pressure chamber 22.

Said pressure chamber 22 is connected to an ink supply unit (not shown), which supplies ink to said pressure chamber 22 from an ink storage unit (not shown) provided as appropriate.

Said piezoelectric element 23, when excited by pulse voltage applied to it, causes the ink contained in said pressure chamber 22 to be discharged forward through said inkjet nozzle 21.

Inkjet print head 2 of the present invention has generally has two or more of said inkjet nozzles 21 placed as a nozzle assembly N.

According to the present invention, inkjet print head 2 can have two or more of said nozzle assemblies N arranged in rows.

Inkjet print head 2 according to the present invention generally refers to such an inkjet print head as described above equipped with a nozzle protecting plate 1.

As shown in FIG. 2, said nozzle protecting plate 1 is provided with a base piece 1A to mount the protecting plate on the inkjet print head 2 at a given distance of L from a nozzle face 24 (See FIG. 3).

According to the present invention, said base piece 1A can be provided as an integral part of the nozzle protecting plate 1 or as a detachable part flexibly ranging in thickness to accommodate distance L, which can be attached to the nozzle protecting plate by using such means as screws or rivets for fastening both together or such means as adhesives for bonding both together.

The nozzle protecting plate 1 can be attached to the inkjet print head surface by urging such means as screws or rivets for fastening both together or such means as adhesives for bonding both together.

The nozzle protecting plate 1 may be constructed of metal or plastic sheet material or molded with said base piece 1A as its integral part.

As shown in FIG. 2, the nozzle protecting plate 1 has an opening formed as a path for discharge of the ink from nozzle 21 to establish its trajectory.

This opening is formed as a plurality of slits 11 along the feeding direction.

Figure 4:
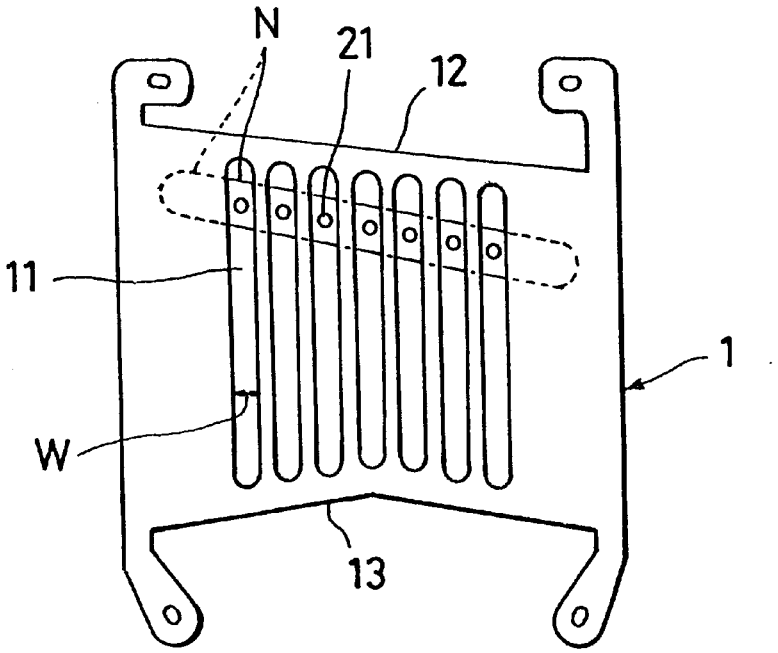
FIG. 4 is a plan view of a nozzle protecting plate embodying the present invention.

Referring now to FIG. 4, there is shown a nozzle protecting plate 1 as another embodiment of the present invention wherein seven slits 11 are arranged at locations corresponding to nozzles 21 in nozzle assembly N placed obliquely.

The inks discharged from the nozzles 21 form their trajectories through the slits 11, reaching the surface of the recording medium onto which they are to be printed. Distance between the nozzle protecting plate and the nozzle face When an inkjet print head according to the present invention is applied to a cloth with long piles for printing image patterns on the cloth, setting the distance between the nozzle face 24 and the nozzle protecting plate 1 (a distance defined as L in FIG. 3) to an allowable maximum length is useful in preventing the adherence of foreign matter on the cloth to said nozzle face.

However, when the distance L is set excessively long, causing the clearance between the nozzle face 24 and the cloth to be widened accordingly, the trajectories of the ink droplets injected from the nozzles to the cloth are subject to deflection, resulting in deteriorated sharpness of the boundaries of the image patterns formed on the cloth.

Conversely, setting the distance L excessively short causes droplets from the discharged ink to be collected in the gap between the nozzle protecting plate 1 and the nozzle face 24.

Experiment 1

To determine the optimal distance between the nozzle protecting plate 1 and the nozzle face 24 in relation to the above-mentioned problem, the inventors conducted an experiment as described below (Experiment 1).

The experiment was made by spraying a cleaning solution onto the nozzles to simulate their cleaning process with different settings of the distance L between the nozzle protecting plate 1 and the nozzle face 24 to observe the drop of the undesired droplets present in the gap between the nozzle protecting plate 1 and the nozzle face 24.

The nozzle protecting plate used in the experiment was 0.3 mm in thickness with its bottom along the cloth feeding direction shaped as shown in FIG. 4 and inclined at an angle of 12° to the scanning direction.

In addition, the experiment included the observation of the quality of the image patterns printed on a recording medium of given length by varying the distance L between the nozzle protecting plate 1 and the nozzle face 24 with the clearance between the nozzle protecting plate 1 and the recording medium surface set at 1.5 mm.

The printing of the cloth was carried out under the following condition:

1̂ Ink: Disperse dye-based four color inks—yellow, magenta, cyan and black.

2̂ Recording system: Serial scanning inkjet printer

3̂ Recording medium: Polyester cloth of plain weave

The results of the experiment are shown in Table 1 attached hereto.

Table 1

TABLE 1

| | Distance L between nozzle protecting plate rear and nozzle face (mm) | | | | | | | | |
|---|---|---|---|---|---|---|---|---|---|
| | 0.2 | 0.4 | 0.6 | 0.8 | 1.0 | 1.5 | 2.0 | 2.5 | 3.0 |
| ① Drop of undesired droplets in the gap | x | Δ | ○ | ○ | ○ | ○ | ○ | ○ | ○ |
| ② Quality of image patterns printed on the cloth | ○ | ○ | ○ | ○ | ○ | ○ | Δ | Δ | x |

<Description of three-grade (○/Δ/x) rating scale for evaluation of the experiment results>

① Drop of undesired droplets in the gap

○ . . . No undesired droplets collected in the gap;

Δ . . . Slight drop of undesired droplets in the gap;

x . . . No drop of undesired droplets collected in the gap

② Quality of image patterns printed on the cloth

○ . . . Excellent

Δ . . . Slightly poor x . . . Poor

The experiment results showed that the distance L between the nozzle protecting plate 1 and the nozzle face 24 should be preferably set in the range of 0.4 mm to 2.5 mm, and more preferably in the range of 0.6 mm to 1.5 mm.

Width of the opening (slit) formed in the nozzle protecting plate.

In reference to width W of the slit 11 opened in the nozzle protecting plate 1 as shown in FIG. 4 according to the present invention, an excessively narrow width W of the slit 11 causes it to form a film of droplets from a cleaning solution used to clean the nozzles (what is called "droplet film"), making it difficult for the droplets to leave it.

Conversely, if the width W of the slit 11 is excessively large, it can solve the problem of forming a droplet film, but instead presents a problem of causing the nozzle face 24 to be prone to undergo adherence of foreign matter present on the recording medium (such as its fluff) to it.

Accordingly, the width W of the slit 11 opened in the nozzle protecting plate along the scanning direction should be preferably set so that it will prevent any foreign matter on the recording medium from adhering to the nozzle face 24 and will not form any such droplet film as described above.

Experiment 2

To determine the optimal width W of the slit 11 in relation to the above-mentioned problem, the inventors conducted an experiment as described below (Experiment 2).

The experiment was made by simulating the process of cleaning the nozzles as done in Experiment 1 with different settings of the width W of the slit 11 opened in the nozzle protecting plate 1 to observe the formation of a droplet film in the slit area.

The nozzle protecting plate used in the experiment was 0.3 mm in thickness with the distance L between the nozzle protecting plate 1 and the nozzle face 24 set at 0.6 mm.

In addition, the experiment included the observation of the adherence of fluff to the nozzle face after scanning the inkjet print head to print on a recording medium of given length by varying the width W of the slit 11 opened in the nozzle protecting plate 1 with the clearance between the nozzle protecting plate 1 and the recording medium surface set at 1.5 mm and the distance L between the nozzle protecting plate 1 and the nozzle face 24 set at 0.6 mm.

The printing of the cloth was carried out under the following condition:

1̂ Ink: Acid dye-based four color inks—yellow, magenta, cyan and black.

2̂ Recording system: Serial scanning inkjet printer

3̂ Recording medium: Napped nylon cloth

The results of the experiment are shown in Table 2 attached hereto.

TABLE 2

| | Width W of slit opened in nozzle protecting plate along scanning direction (mm) | | | | | | | | |
|---|---|---|---|---|---|---|---|---|---|
| | 0.2 | 0.4 | 0.6 | 0.8 | 1.0 | 1.3 | 1.5 | 1.8 | 2.0 |
| ① Formation of droplet film in slit area | x | Δ | ○ | ○ | ○ | ○ | ○ | ○ | ○ |
| ② Adherence of fluff to nozzle face | ○ | ○ | ○ | ○ | ○ | Δ | Δ | x | x |

<Description of three-grade (○/Δ/x) rating scale for evaluation of the experiment results>
① Formation of droplet film in slit area
○ . . . No droplet film formed;
Δ . . . Droplet film partially formed;
x . . . Droplet film formed
② Adherence of fluff to nozzle face
○ . . . 0 to 4 pieces of fluff
Δ . . . 5 to 10 pieces of fluff
x . . . 11 or more pieces of fluff The experiment results showed with the width W of the slit 11 should be preferably set in the range of 0.4 mm to 1.5 mm, and more preferably in the range of 0.6 mm to 1.0 mm.

Shape of nozzle protecting plate's top and bottom along feeding direction

The nozzle protecting plate 1 shown in FIG. 4, as a feature of the present invention, has its top 12 (precisely its top along the feeding direction) inclined descending rightward and its bottom 13 (precisely its bottom along the feeding direction) shaped like an inverted V.

As a further feature of the present invention, the nozzle protecting plate 1 is so structured that the inclined portion of its top and the inverted V shaped portion of its bottom have their respective terminals connected to the base piece 1A.

This structure allows the base piece to efficiently guide the flow of the droplets adhering to the nozzle protecting plate 1.

Figure 5:
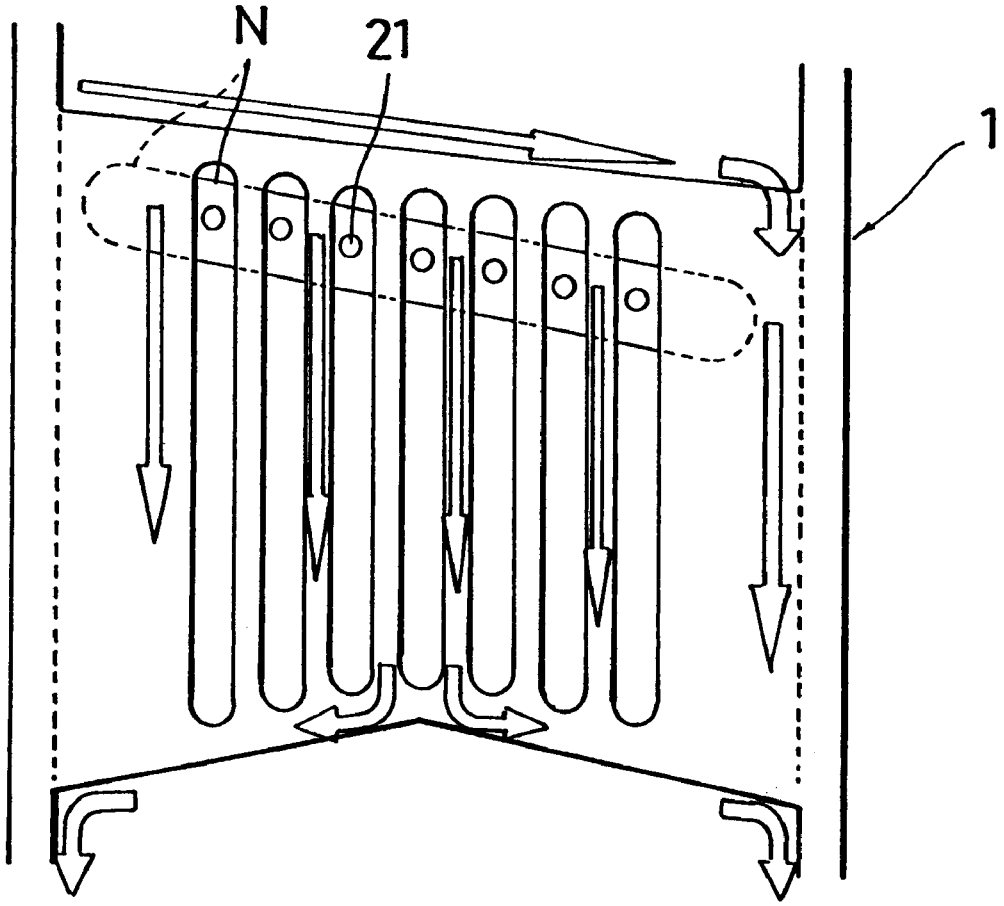
FIG. 5 is a plan view of a nozzle protecting plate of the present invention, showing the direction in which ink droplets on the nozzle protecting plate flow.

FIG. 5 shows the directions of the droplets' flow thus guided.

In FIG. 5, the droplets adhering to the nozzle protecting plate 1 flow rightward on its top, while those adhering to the slit area flow downward and then divide along the inverted V shape into right and left to further flow down.

Figure 6:
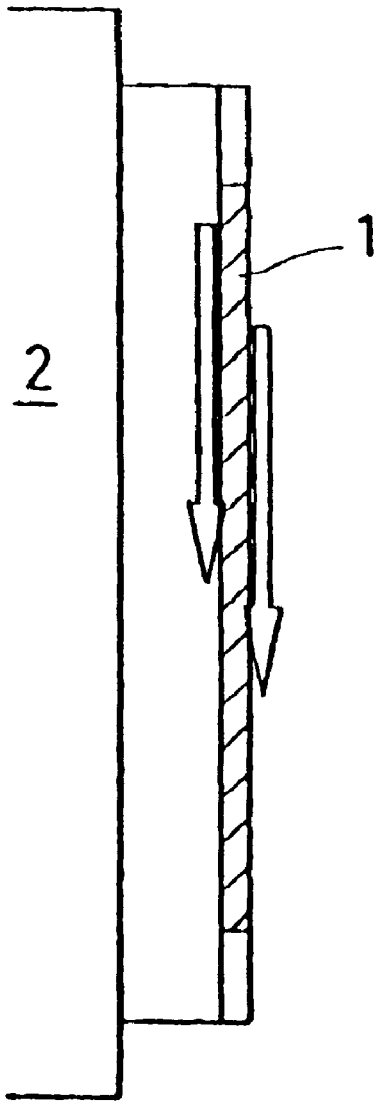
FIG. 6 is a partially sectional view of a nozzle protecting plate of the present invention, showing the direction in which ink droplets on the nozzle protecting plate flow.

Needless to say, the flow of these droplets, as shown in FIG. 6, occurs along both the front and back sides of the nozzle protecting plate 1.

As described above, most of the droplets adhering to the nozzle protecting plate 1 of the present invention move along its top 12 and bottom 13 toward the base piece 1A, along which they thereafter flow down, eventually departing from the nozzle protecting plate 1.

Figure 7:
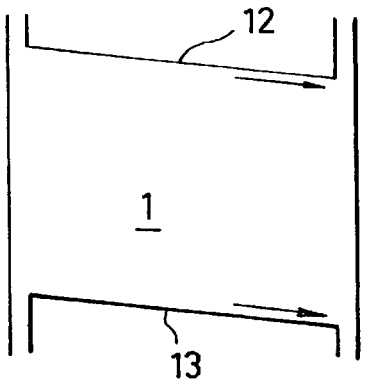
FIGS. 7A–7F show the shapes of the top and bottom of a nozzle protecting plate embodying the present invention.
Figure 7:
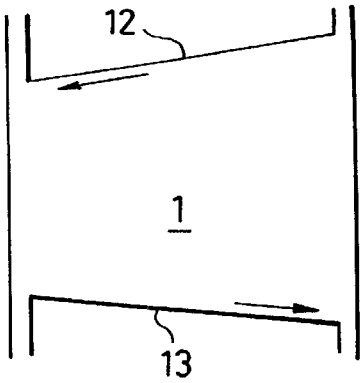
Figure 7:
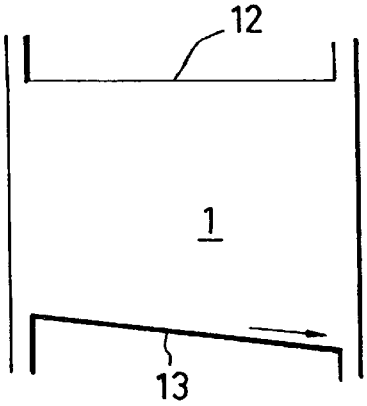
Figure 7:
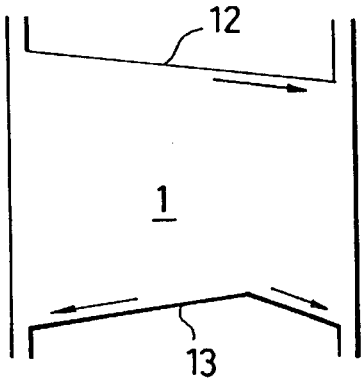
Figure 7:
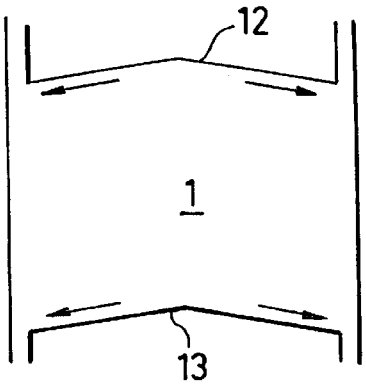
Figure 7:
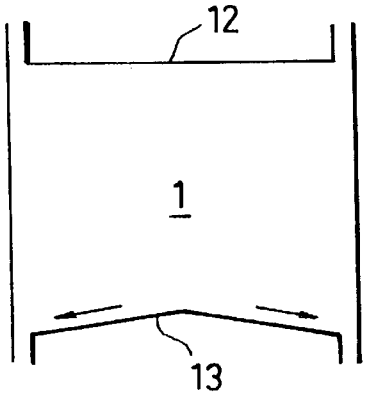

According to the present invention, the nozzle protecting plate 1 can have its top 12 and bottom 13 shaped as illustrated in FIG. 7 in addition to examples of their respective shapes given in FIG. 4 to effectively assist the droplets on it to flow downward.

More specifically referring to FIG. 7, which shows several typical examples of the nozzle protecting plate 1 of the present invention, only sketching its top 12 and bottom 13 without its slit area to illustrate schematically the flows of the droplets on it, (A) both the top and bottom are inclined descending rightward;

(B) the top is inclined descending leftward, while the bottom is inclined descending rightward;

(C) the top is not inclined, but parallel, while the bottom is inclined descending rightward;

(D) the top is inclined descending rightward, while the bottom is shaped like a slightly unequal-sided inverted V;

(E) the top is shaped like an equal-sided inverted V, while the bottom is also shaped like an equal-sided inverted V; and (F) the top is not inclined, but parallel, while the bottom is shaped like an equal-sided inverted V.

According to the present invention, the nozzle protecting plate 1 has generally its top and bottom shaped as illustrated above to facilitate the flow of the droplets on it as indicated by the arrows.

More specifically, the nozzle protecting plate 1 of the present invention has its top 12 or bottom 13 (precisely its top or bottom along the feeding direction) inclined in one direction, preferably at an angle of $\alpha$ (5° to 45°) to the scanning direction, or like an inverted V shape, preferably at an angle of $\alpha$ (5° to 45°) to the scanning direction, to allow the droplets collected on the top 12 or bottom 13 to be guided by the inclination to the base piece 1A, along which they flow downward, eventually departing from the nozzle protecting plate 1 to drop along the inkjet print head face to other places.

The above-described structural feature of the inkjet print head of the present invention allows ink droplets from the nozzles 21 to little prone to collect in the nozzle area (described later) between the nozzle protecting plate 1 and the nozzle face, and prevents any droplet residue left outside of the nozzle area from flying out during the printing process to stain the recording medium.

This structure of the inkjet print head referred to in the present invention shows its effectiveness not only against the ink discharged from the nozzles 21, but also against droplet residues on the nozzle protecting plate 1 from a cleaning solution used to clean the nozzles, therefore contributing to improved efficiency of the cleaning of the nozzles. Length of the opening (slit) formed in the nozzle protecting plate With particular reference to the opening (slit 11) in the nozzle protecting plate 1 shown in the drawings as a feature of the present invention, it may be preferably formed as extended downward from the nozzle area Z (where nozzle assembly N is located).

Figure 8:
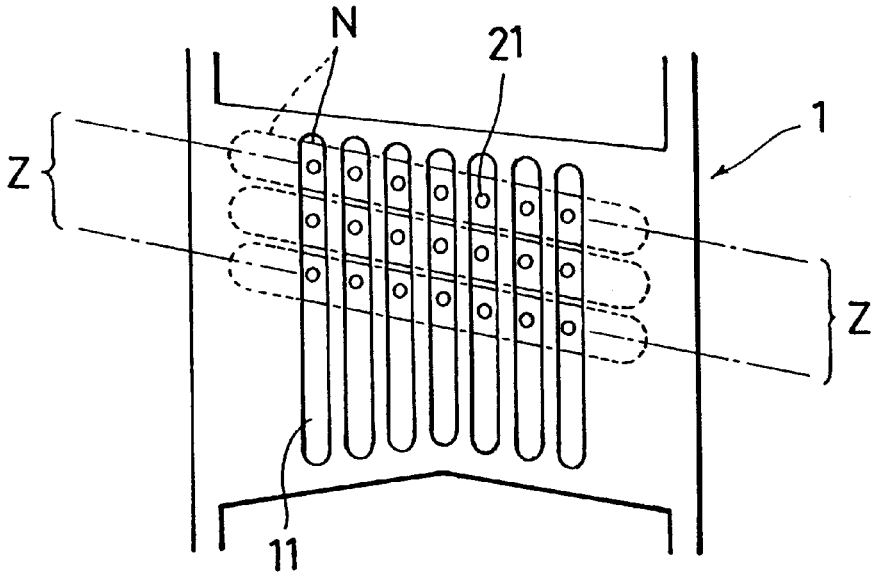
FIG. 8 illustrates an opening (slit) formed on a nozzle protecting plate as extended downward from the nozzle area according to the present invention.

As shown in FIG. 4 or FIG. 8, for example, the nozzle protecting plate 1 according to the present invention has the opening (slit 11) formed as extended downward from the area where the nozzle assembly N is located (which is called herein the nozzle area Z).

If the opening (slit 11) in the nozzle protecting plate 1 is so formed as described above according to the present invention, any droplet film, if temporarily formed in the nozzle area Z of the opening (slit 11), will move downward along it by gravity to a place other than the nozzle area Z.

This droplet film, even if thus moved to any place in the opening (slit 11), is caused to depart from the nozzle protecting plate 1 in due time through vibration or other physical force applied to it during the printing process. Surface treatment of the nozzle protecting plate The nozzle protecting plate 1 mounted on the inkjet print head 2 according to the present invention preferably has its surface treated to display a hydrophilic property.

Such treatment can be achieved by using, for example, the method of forming an oxide film such as $SiO_2$, $ZrO_2$, $TiO_2$ or $Al_2O_3$ or a metal film such as Cr or Ni by spattering, vacuum deposition, plating, etc. or the method of adsorbing a compound with a hydrophilic group such as a surface active agent or a dye with a hydrophilic or hydrophobic group.

These methods can be selected appropriately according to the material of the nozzle protecting plate 1.

Other methods available to provide the nozzle protecting plate 1 with a hydrophilic property according to the present prevention include a method whereby it is constructed of hydrophilic metal or other material, a physical processing method if it is constructed of metal, whereby its surface is roughened using abrasive particles, and a surface modifying method if it is constructed of polymer material, whereby its surface is modified using plasma, corona discharge, UV or other similar sources of energy.

Such surface treatment as described above allows the droplets on the nozzle protecting plate surface to decrease in their surface tension, preventing them from assuming spherical shapes.

The droplets thus decreased in their surface tension on the surface of the nozzle protecting plate 1, once guided to its top 12 or bottom 13, will thereafter, as explained earlier herein, flow downward along the inclination of the top 12 or bottom 13 to the base piece 1A, along which they further flow down, eventually departing from the nozzle protecting plate 1.

Having described the present invention as related to the embodiments shown in the accompanying drawings, it is our intention that the present invention may be embodied variously without departure from the spirit or scope of the invention.

For example, the invention can be modified with various changes made in the arrangements of the openings (slits 11) in the nozzle protecting plate 1 in relation to nozzle assemblies N.

Figure 9:
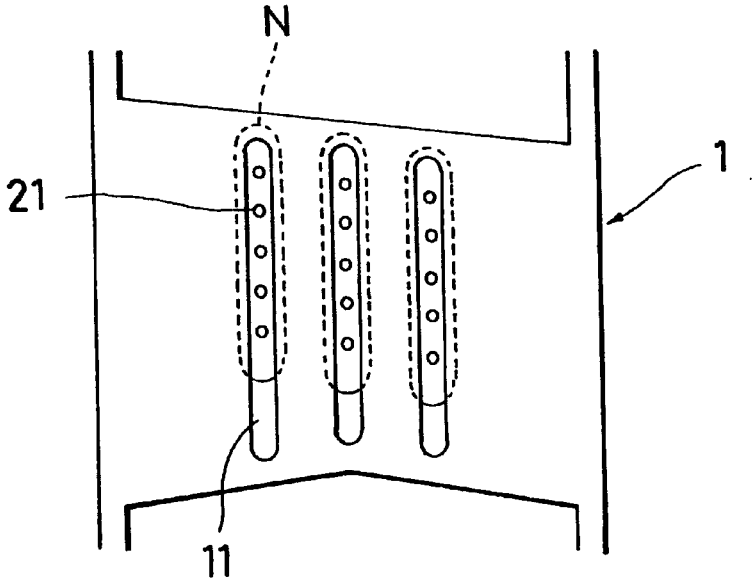
FIG. 9 shows the openings (slits) in a nozzle protecting plate arranged in relation to nozzle assemblies according to the present invention.

FIG. 9 illustrates a first specific embodiment of such a modification of the invention, in which three slits 11 in the nozzle protecting plate 1 are arranged in such rows as to correspond to three nozzle assemblies N, each having five nozzles 21.

Figure 10:
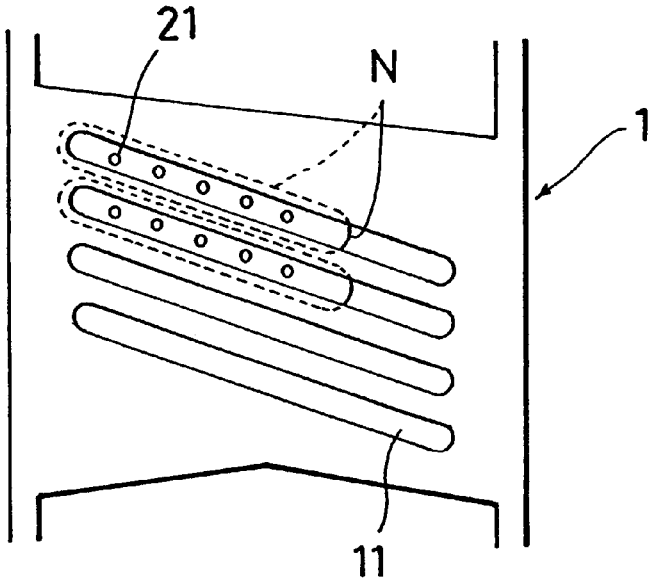
FIG. 10 shows the openings (slits) in a nozzle protecting plate arranged in relation to nozzle assemblies according to the present invention.

A second specific embodiment of such a modification of the invention is shown in FIG. 10, in which two slits 11 in the nozzle protecting plate 1 (inclined at a certain angle to the scanning direction) are arranged in such rows as to correspond to two nozzle assemblies N, each having five nozzles 21.

Figure 11:
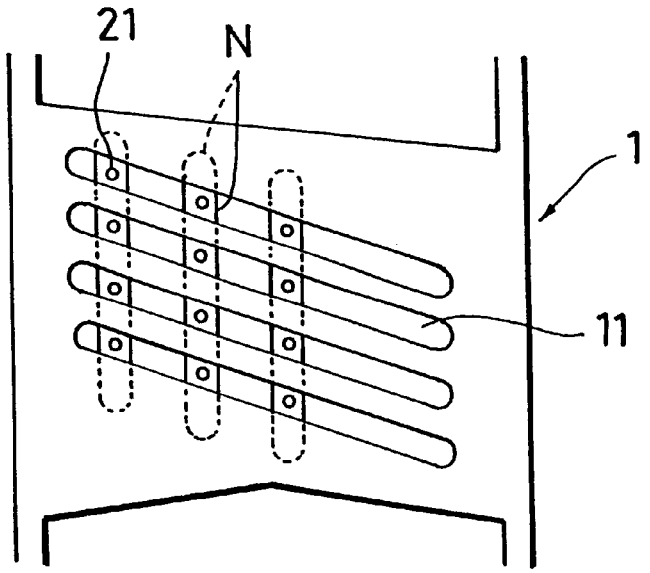
FIG. 11 shows the openings (slits) in a nozzle protecting plate arranged in relation to nozzle assemblies according to the present invention.

In FIG. 11 which illustrates a third specific embodiment of such a modification of the invention, slits 11 in the nozzle protecting plate 1 (similarly inclined at a certain angle to the scanning direction) are arranged in such rows as to correspond to three nozzle assemblies N, each having four nozzles 21.

As described above, the present invention is advantageous in that slits 11 in the nozzle protecting plate 1 may be arranged in any selected rows corresponding to nozzle assemblies N to enhance the freedom of their arrangement in the inkjet print head.

The nozzle protecting plate of the present invention may be used in combination with a wiping mechanism as required for cleaning of its surface.

In addition, the nozzle protecting plate embodied according to the present invention allows the use of a capping mechanism only with adjustment of the cap member size for cleaning of the ink supply path.

Inks for use with the inkjet recorder of the present invention can be selected optionally from any and all types of inks including water-soluble dye inks, disperse dye inks, pigment inks and hot-melt type inks.

The inkjet print head constructed according to the present invention has the advantage of securely protecting the nozzle face against contact and collision with a recording medium and adherence of foreign matter on the recording medium to it, irrespective of the arrangement of the nozzles and the type of the recording medium used.

In addition, the inkjet print head of such construction as described herein is advantageous in efficient removal of undesired droplets collected on it. As a result, the inkjet print head of the present invention successfully achieves improvement in the stability of the ink discharge from its nozzles onto a recording medium, resulting in improved quality of image patterns formed on the recording medium.

What is claimed is:

1. An inkjet print head with an assembly of more than one nozzle, designed to be scanned over a cloth while injecting inks from the nozzles onto the cloth to form image patterns on it, comprising a nozzle protecting plate mounted on the print head at a distance of 0.4 to 2.5 mm from the nozzle face, said nozzle protecting plate having more than one slit formed in rows with its longer dimension parallel to the cloth feeding direction as paths for discharge of the inks, the dimension of said slit perpendicular to the cloth feeding direction ranging from 0.4 mm to 1.5 mm, said slit having an area extended downward from the nozzle area, and said nozzle protecting plate having its top and bottom (along the cloth feeding direction) inclined in one or two directions.

2. An inkjet print head with an assembly of more than one nozzle, designed to be scanned over a cloth while injecting inks from the nozzles onto the cloth to form image patterns on it, comprising a nozzle protecting plate mounted on the print head at a given distance from the nozzle face, said nozzle protecting plate having a slit or slits formed with its longer dimension parallel to the cloth feeding direction as a path or paths for discharge of the inks.

3. An inkjet print head as claimed in claim 2, wherein two or more of said slits are provided in rows.

4. An inkjet print head as claimed in claim 2, wherein said slit has an area extended downward from the nozzle area.

5. An inkjet print head as claimed in claim 2, wherein the dimension of said slit perpendicular to the cloth feeding direction ranges from 0.4 mm to 1.5 mm.

6. An inkjet print head with an assembly of more than one nozzle, designed to be scanned over a cloth while injecting inks from the nozzles onto the cloth to form image patterns on it, comprising a nozzle protecting plate mounted on the print head at a given distance from the nozzle face, said nozzle protecting plate having an opening or openings formed as a path of paths for discharge of the inks and the top and bottom of the nozzle protecting plate, along the cloth feeding direction, are inclined in one or more directions.

7. An inkjet print head with an assembly of more than one nozzle, designed to be scanned over a cloth while injecting inks from the nozzles onto the cloth to form image patterns on it, comprising a nozzle protecting plate mounted on the print head at a given distance from the nozzle face, said nozzle protecting plate having an opening or openings formed as a path of paths for discharge of the inks and its surface is treated to have a hydrophilic property.

* * * * *